US008433220B2

(12) United States Patent
Hoshino

(10) Patent No.: US 8,433,220 B2
(45) Date of Patent: Apr. 30, 2013

(54) IMAGE FORMING APPARATUS HAVING TRANSFER MEMBER AND CONTROL METHOD FOR ADJUSTING DRIVE TORQUE FOR THE TRANSFER MEMBER

(75) Inventor: Takashi Hoshino, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 782 days.

(21) Appl. No.: 12/569,404

(22) Filed: Sep. 29, 2009

(65) Prior Publication Data

US 2010/0150593 A1 Jun. 17, 2010

(30) Foreign Application Priority Data

Dec. 15, 2008 (JP) ..... 2008-318310

(51) Int. Cl.
*G03G 15/16* (2006.01)

(52) U.S. Cl.
USPC ..... 399/121

(58) Field of Classification Search ..... 399/66, 399/121, 126, 313; 310/78, 92, 94, 96; 475/5
See application file for complete search history.

(56) References Cited

U.S. PATENT DOCUMENTS 5,946,525 A * 8/1999 Okamura et al. ..... 399/66
6,009,298 A * 12/1999 Sakamaki et al.
6,343,203 B1 * 1/2002 Pang
2005/0111861 A1 5/2005 Calamita et al.
2007/0025768 A1 * 2/2007 Komatsu et al.
2008/0019717 A1 1/2008 Soshiroda
2008/0175612 A1 * 7/2008 Oikawa et al. ..... 399/66
2009/0162118 A1 * 6/2009 Noguchi et al.

FOREIGN PATENT DOCUMENTS

| | | |
|---|---|---|
| JP | 2002-372871 | 12/2002 |
| JP | 2005-153525 | 6/2005 |
| JP | 2005-258288 | 9/2005 |
| JP | 2008-026390 | 2/2008 |

* cited by examiner

*Primary Examiner* — Walter L Lindsay, Jr.
*Assistant Examiner* — Milton Gonzalez
(74) *Attorney, Agent, or Firm* — Sughrue Mion, PLLC

(57) ABSTRACT

An image forming apparatus includes: an image holder that holds an image; a transfer unit that includes a transfer member being rotationally driven and forming a pressing portion between the transfer member and the image holder, and that presses a recording medium under transportation at the pressing portion so as to transfer the image held by the image holder onto the transported recording medium; and an adjustment unit that adjusts drive torque for the transfer member by changing the drive torque from a first adjustment state to a second adjustment state, either when a leading edge of the recording medium reaches the pressing portion or when a trailing edge of the recording medium leaves the pressing portion.

5 Claims, 5 Drawing Sheets

IMAGE FORMING APPARATUS HAVING TRANSFER MEMBER AND CONTROL METHOD FOR ADJUSTING DRIVE TORQUE FOR THE TRANSFER MEMBER

CROSS REFERENCE TO RELATED APPLICATIONS

This application is based on and claims priority under 35 USC §119 from Japanese Patent Application No. 2008-318310 filed Dec. 15, 2008.

BACKGROUND

1. Technical Field

The present invention relates to an image forming apparatus and the like, more specifically, an image forming apparatus and the like using an intermediate transfer body.

2. Related Art

An image forming apparatus using an intermediate transfer body have so far employed a transfer device of a backup roll type. In such a transfer device, when toner images and the like transferred onto a belt-like intermediate transfer body are collectively and secondarily transferred onto a recording medium, the intermediate transfer body is supported from an inner side thereof by the backup roll, a secondary transfer roll is brought into contact with a front surface side of the intermediate transfer body, and a voltage is supplied to the backup roll.

SUMMARY

According to an aspect of the present invention, there is provided an image forming apparatus including: an image holder that holds an image; a transfer unit that includes a transfer member being rotationally driven and forming a pressing portion between the transfer member and the image holder, and that presses a recording medium under transportation at the pressing portion so as to transfer the image held by the image holder onto the transported recording medium; and an adjustment unit that adjusts drive torque for the transfer member by changing the drive torque from a first adjustment state to a second adjustment state, either when a leading edge of the recording medium reaches the pressing portion or when a trailing edge of the recording medium leaves the pressing portion.

BRIEF DESCRIPTION OF THE DRAWINGS

Exemplary embodiment (s) of the present invention will be described in detail based on the following figures, wherein.

DETAILED DESCRIPTION

An exemplary embodiment of the present invention will be described below. It is to be noted that the present invention is not limited to this exemplary embodiment to be given below and may be implemented with various modifications within its scope. In addition, the drawings to be used are for illustrating this exemplary embodiment, and do not show actual sizes.

Figure 1:
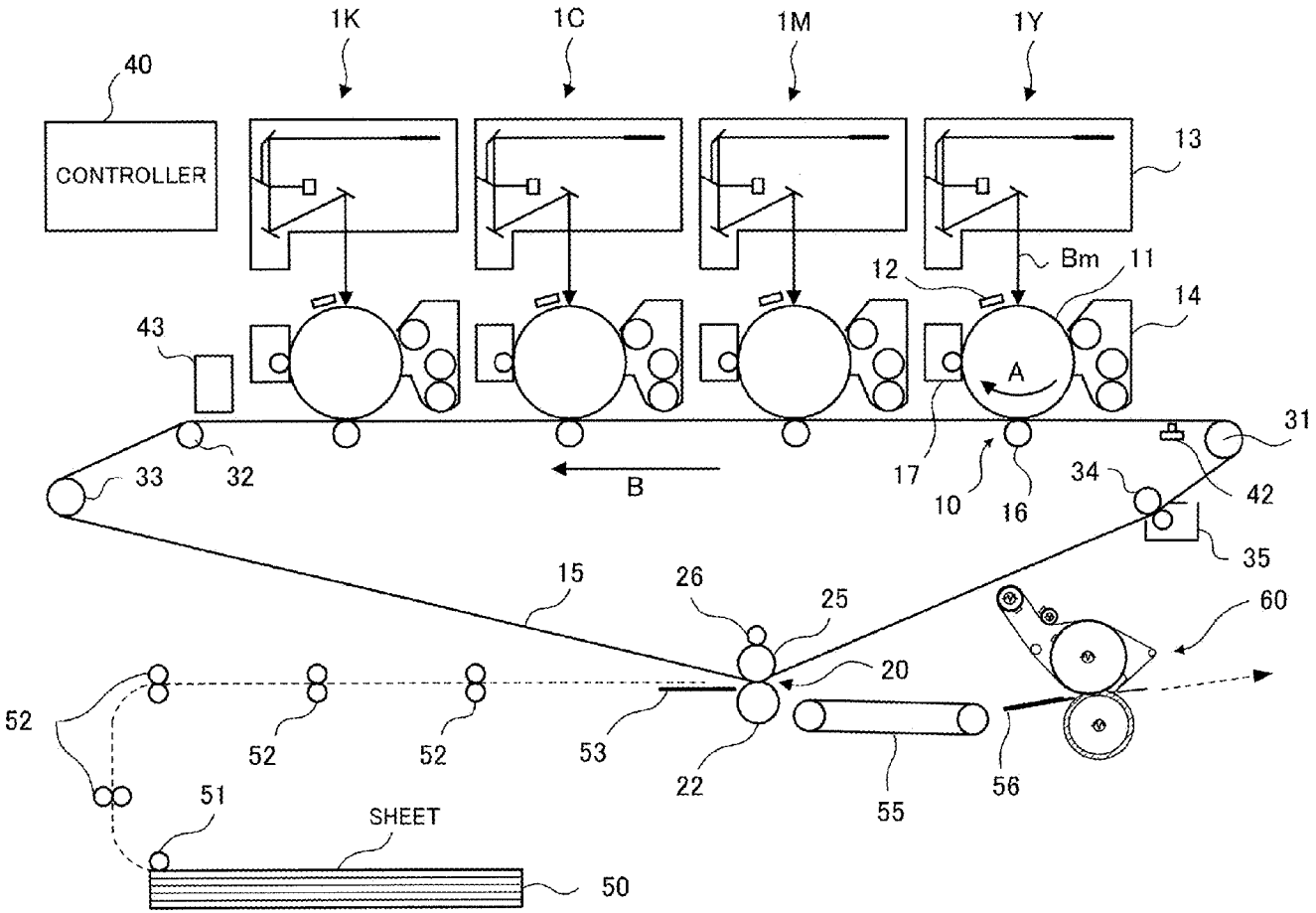
FIG. 1 is a schematic configuration diagram of an image forming apparatus to which the exemplary embodiment is applied.

FIG. 1 is a schematic configuration diagram of an image forming apparatus to which the exemplary embodiment is applied. Here, descriptions will be given by taking an image forming apparatus employing an intermediate transfer type, generally called a tandem-type image forming apparatus, as an example. An image forming apparatus shown in FIG. 1 includes, as toner image formation units, multiple image forming units 1Y, 1M, 1C and 1K each of which forms a toner image of a corresponding color component by electrophotography. Moreover, the image forming apparatus includes, as transfer units: primary transfer units 10 that sequentially transfer (primarily transfer) the toner images of the respective color components formed by the image forming units 1Y, 1M, 1C and 1K, onto an intermediate transfer belt (image holder) 15; and a secondary transfer unit 20 that collectively transfers (secondarily transfers) overlapped toner images, which are transferred onto the intermediate transfer belt 15, onto a sheet serving as a recording medium (recording sheet). Moreover, the image forming apparatus includes, as a fixing unit, a fixing device 60 that fixes the secondarily transferred image on the sheet. The image forming apparatus also includes a controller 40 that controls operation of each device (unit).

As shown in FIG. 1, each of the image forming units 1Y, 1M, 1C and 1K includes a photoconductive drum 11, a charging device 12, a laser exposure device 13, a developing device 14, a primary transfer roll 16 and a drum cleaner 17. The photoconductive drum 11 rotates in an arrow A direction. The charging device 12 charges the photoconductive drum 11. The laser exposure device 13 writes an electrostatic latent image on the photoconductive drum 11 (an exposure beam thereof is denoted by Bm in FIG. 1). The developing device 14 stores a toner of the corresponding color component and forms, with the toner, a visible image of the electrostatic latent image written on the photoconductive drum 11. The primary transfer roll 16 transfers, in the primary transfer unit 10, the toner image of the corresponding color component formed on the photoconductive drum 11 onto the intermediate transfer belt 15. The drum cleaner 17 removes the toner remaining on the photoconductive drum 11. These image forming units 1Y, 1M, 1C and 1K are disposed in an approximately straight line in the order of yellow (Y), magenta (M), cyan (C) and black (K) from an upstream side of the intermediate transfer belt 15.

The intermediate transfer belt 15 is circularly driven (rotated) by various rolls in an arrow B direction shown in FIG. 1. The various rolls include: a driving roll (image holder driving member) 31, a supporting roll 32, a tension roll 33, a backup roll 25 and a cleaning backup roll 34. The driving roll 31 rotates the intermediate transfer belt 15. The supporting roll 32 supports the intermediate transfer belt 15. The tension roll 33 applies tension to the intermediate transfer belt 15 so as to prevent meandering thereof. The backup roll 25 is provided in the secondary transfer unit 20. The cleaning backup roll 34 is provided in a cleaning unit that wipes off remaining toners on the intermediate transfer belt 15.

Each primary transfer unit 10 includes the primary transfer roll 16 that is disposed so as to be opposed to the photoconductive drum 11 with the intermediate transfer belt 15 interposed therebetween. A voltage (primary transfer bias) having polarity opposite to the charging polarity (minus polarity) of the toner is applied to the primary transfer roll 16. Thereby, the toner images on the respective photoconductive drums 11 are electrostatically attracted to the intermediate transfer belt 15 in sequence, and then, superimposed toner images are formed on the intermediate transfer belt 15.

The secondary transfer unit 20 includes a secondary transfer roll (transfer member) 22, the backup roll 25 and a metallic power feeding roll 26. The secondary transfer roll 22 is disposed on the toner image holding surface side of the intermediate transfer belt 15. The backup roll 25 is disposed on a back surface side of the intermediate transfer belt 15, and serves as an opposite electrode of the secondary transfer roll 22. The metallic power feeding roll 26 is in contact with the backup roll 25, and stably applies a secondary transfer bias thereto.

On the downstream side of the secondary transfer unit 20 of the intermediate transfer belt 15, an intermediate transfer belt cleaner 35 is provided so as to be freely moved toward and away from the intermediate transfer belt 15. The intermediate transfer belt cleaner 35 removes remaining toner and paper dust on the intermediate transfer belt 15 after the secondary transfer. On the upstream side of the image forming unit 1Y for yellow, a reference sensor (home position sensor) 42 that generates a reference signal for adjusting timing of image formation in the respective image forming units 1Y, 1M, 1C and 1K is disposed. Moreover, on the downstream side of the image forming unit 1K for black, an image density sensor 43 for adjusting image quality is disposed. The reference sensor 42 generates the reference signal by recognizing a mark provided on aback side of the intermediate transfer belt 15. The respective image forming units 1Y, 1M, 1C and 1K start image formation in response to an instruction from the controller 40 based on the recognition of the reference signal.

The image forming apparatus of the present exemplary embodiment is provided with, as a recording sheet transportation system, a sheet storing unit 50, a pickup roll 51, transporting rolls 52, a transporting chute 53, a transporting belt 55 and a fixing entrance guide 56. The sheet storing unit 50 stores sheets. The pickup roll 51 takes out and transports the sheet stored in the sheet storing unit 50. The transporting rolls 52 transport the sheet. The transporting chute 53 feeds the sheet to the secondary transfer unit 20. The transporting belt 55 transports the sheet, which is secondarily transferred by the secondary transfer roll 22, to the fixing device 60. The fixing entrance guide 56 guides the sheet into the fixing device 60.

Next, a basic image forming process of the image forming apparatus will be described.

In the image forming apparatus as the one shown in FIG. 1, image processing is performed by an image processing system (IPS) (not shown in the figure) on image data outputted from an image input terminal (IIT) (not shown in the figure), a personal computer (PC) (not shown in the figure) or the like, and then, an image forming operation is executed by the image forming units 1Y, 1M, 1C and 1K. In the IPS, image processing such as shading correction, displacement correction, lightness and color space conversion, gamma correction, various kinds of image editing like a frame erase, color editing, move editing and the like are performed on inputted reflectance data. The image data on which the image processing has been performed is converted into the color tone data of the four colors of Y, M, C and K. Then, the color tone data is outputted to the laser exposure device 13.

The laser exposure device 13 irradiates the respective photoconductive drums 11 of the image forming units 1Y, 1M, 1C and 1K with the exposure beam Bm emitted from, for example, a semiconductor laser in accordance with the inputted color tone data. After each surface of the photoconductive drums 11 of the image forming units 1Y, 1M, 1C and 1K is charged by the corresponding charging device 12, the surface is scanned and exposed by the laser exposure device 13, and thereby an electrostatic latent image is formed thereon. The electrostatic latent image thus formed is developed as a toner image of the corresponding color Y, M, C or K, by the corresponding image forming unit 1Y, 1M, 1C or 1K.

Then, in the primary transfer units 10 where each of the photoconductive drums 11 is in contact with the intermediate transfer belt 15, primary transfer is performed as follows. A voltage (primary transfer bias) having polarity opposite to the charging polarity (minus polarity) of the toner is applied by the primary transfer roll 16 to a base material of the intermediate transfer belt 15. Each of the toner images formed on the corresponding photoconductive drum 11 is superimposed on the surface of the intermediate transfer belt 15 in sequence.

After the toner images are primarily transferred onto the surface of the intermediate transfer belt 15 in sequence, the toner images are transported to the secondary transfer unit 20 by movement of the intermediate transfer belt 15. In the recording sheet transporting system, the pickup roll 51 rotates in accordance with the timing when the toner images are transported to the secondary transfer unit 20, and the sheet is supplied from the sheet storing unit 50. The sheet supplied by the pickup roll 51 is transported by the transporting rolls 52 and reaches the secondary transfer unit 20 via the transporting chute 53. Before reaching the secondary transfer unit 20, the sheet is stopped once. Then, a registration roll (not shown in the figure) rotates in accordance with the moving timing of the intermediate transfer belt 15 on which the toner images are held, so that the position of the sheet and the position of the toner images are aligned.

At the secondary transfer unit 20, the secondary transfer roll 22 is pressed against the backup roll 25 while having the intermediate transfer belt 15 interposed therebetween. Then, the unfixed toner images held on the intermediate transfer belt 15 are collectively and electrostatically transferred onto the sheet sandwiched between the intermediate transfer belt 15 and the secondary transfer roll 22.

Thereafter, the sheet on which the toner images are electrostatically transferred is transported by the secondary transfer roll 22 in the state where the sheet is removed from the intermediate transfer belt 15, and further transported to the transporting belt 55 provided on the downstream side of the secondary transfer roll 22 in the recording sheet transporting direction. The transporting belt 55 transports the sheet to the fixing device 60. The fixing device 60 processes the unfixed toner image on the sheet with heat and pressure to thereby fix the toner image on the sheet. The sheet on which the fixed image is formed is transported to a sheet output portion provided in an exit unit of the image forming apparatus.

After the transfer onto the sheet is completed, remaining toner on the intermediate transfer belt 15 is transported as far as the cleaning unit according to the rotational movement of the intermediate transfer belt 15. The remaining toner is removed from the intermediate transfer belt 15 by the cleaning backup roll 34 and the intermediate transfer belt cleaner 35.

Figure 2:
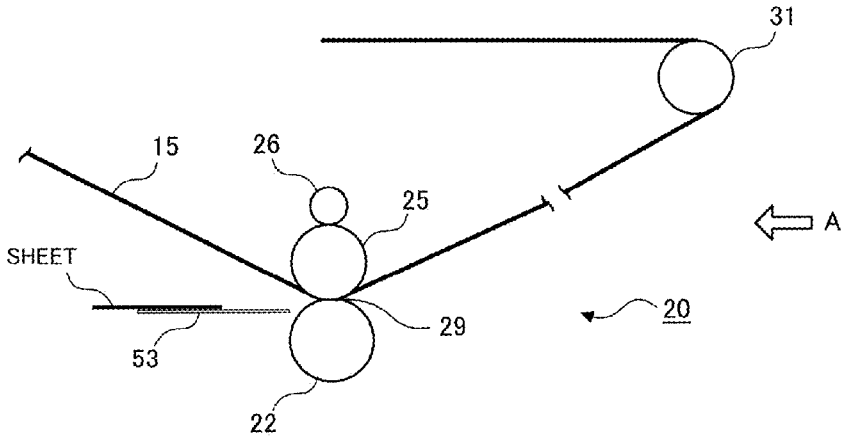
FIG. 2 is a view illustrating the secondary transfer unit.

FIG. 2 is a view illustrating the secondary transfer unit 20.

As described above, the secondary transfer unit 20 includes: the secondary transfer roll (transfer member) 22 disposed on the toner image holding surface side of the intermediate transfer belt (image holder) 15; the backup roll 25; and the power feeding roll 26 as an opposed electrode of the secondary transfer roll 22. Here, a power supply as a transfer power supply is connected to the power feeding roll 26, although not shown in FIG. 2. Between the intermediate transfer belt 15 and the secondary transfer roll 22, a nip portion 29 between which a sheet transported by the recording sheet transportation system is inserted is formed.

The secondary transfer roll 22 generally has a structure including: a rotating shaft made of metal; a foam layer made by foam of, for example, epichlorohydrin rubber, urethane rubber or the like; a solid layer made of epichlorohydrin rubber, urethane rubber or the like; and a coating layer. The volume resistivity of the secondary transfer roll 22 is generally set within the range of 103 Ω·cm to 1010 Ω·cm.

The backup roll 25 generally includes: a rotating shaft made of metal; and an elastic layer having a single layer or multiple layers made of a rubber material such as EPDM or epichlorohydrin rubber. The volume resistivity of the backup roll 25 is set within the range of 103 Ω·cm to 1010 Ω·cm. The power feeding roll 26 is made of metal.

The secondary transfer roll 22 is disposed so as to be pressed against and in contact with the backup roll 25 with the intermediate transfer belt 15 interposed therebetween. Moreover, the secondary transfer roll 22 is grounded and thereby forms the secondary transfer bias between itself and the backup roll 25 to secondarily transfer the toner images onto the sheet transported into the secondary transfer unit 20.

In the secondary transfer unit 20, the secondary transfer roll 22 is pressed against the backup roll 25 while having the intermediate transfer belt 15 interposed therebetween. Then, the sheet reaching the secondary transfer unit 20 through the transporting chute 53 from the recording sheet transportation system is inserted into the nip portion (pressing portion) 29 between the intermediate transfer belt 15 and the secondary transfer roll 22. At this time, a voltage (secondary transfer bias) having the same polarity as the charging polarity (minus polarity) of the toners is applied from the power feeding roll 26, thereby forming a transfer electric field between the secondary transfer roll 22 and the backup roll 25. Then, the unfixed toner images held on the intermediate transfer belt 15 are pressed on the sheet by the secondary transfer roll 22 and the backup roll 25 in the secondary transfer unit 20, and are thus collectively and electrostatically transferred onto the sheet.

Figure 3:
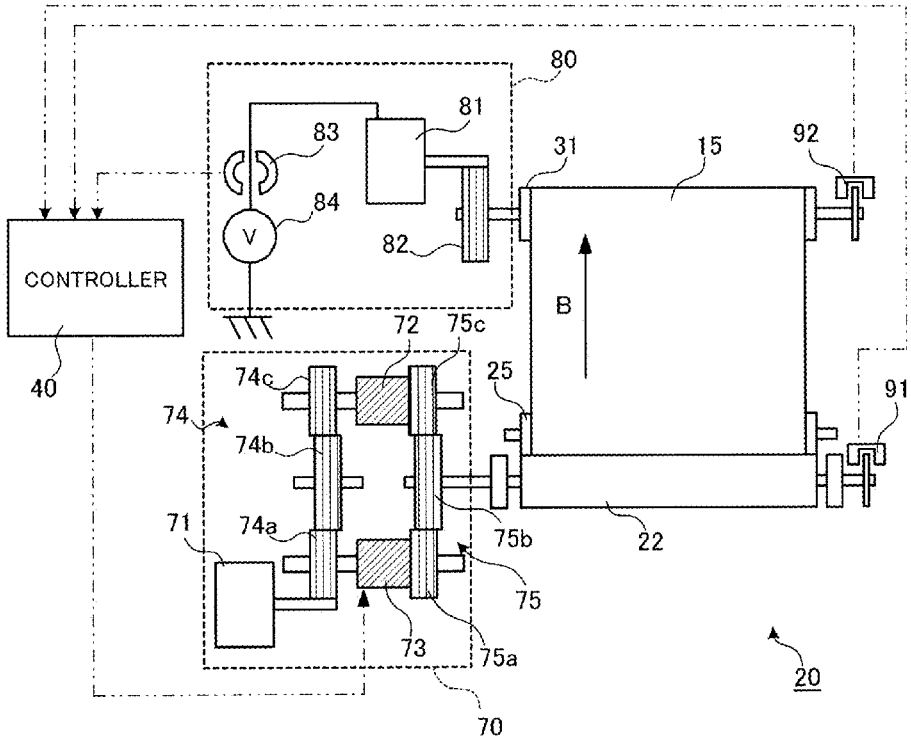
FIG. 3 is a view illustrating a configuration of a drive mechanism for driving the intermediate transfer belt and the secondary transfer unit.

FIG. 3 is a view illustrating a configuration of a drive mechanism for driving the intermediate transfer belt 15 and the secondary transfer unit 20, according to the present exemplary embodiment. FIG. 3 shows a schematic configuration diagram of the secondary transfer unit 20 shown in FIG. 2 seen in an arrow A direction.

Here, the secondary transfer unit 20 includes: a secondary transfer roll drive mechanism 70 that drives the secondary transfer roll 22 and that serves as an adjustment unit for driving torque; and an intermediate transfer belt drive mechanism 80 that drives the intermediate transfer belt 15. Moreover, the secondary transfer unit 20 includes: a first rotary encoder 91 that detects changes in the rotational speed of the secondary transfer roll 22; and a second rotary encoder 92 that detects changes in the rotational speed of the driving roll 31 driving the intermediate transfer belt 15. Furthermore, the secondary transfer unit 20 is provided with a controller 40 that controls the secondary transfer roll drive mechanism 70.

The secondary transfer roll drive mechanism 70 includes: a first drive motor 71 that drives the secondary transfer roll 22; a torque limiter 72 that controls the upper limit value of drive torque for the first drive motor 71; and an electromagnetic clutch 73 that is turned on or off according to a control signal from the controller 40. The secondary transfer roll drive mechanism 70 also includes: a gear train 74 (gears 74*a*, 74*b* and 74*c*) of the first drive motor 71 side that transmits the drive torque of the first drive motor 71; and a gear train 75 (gears 75*a*, 75*b* and 75*c*) of the secondary transfer roll 22 side.

Here, the torque limiter 72 is generally a safety device for overload applied to machinery (overload protector). When torque exceeding a designed value acts on the machinery, the torque limiter 72 cuts off transmission of the torque. The torque limiter 72 may be a flange type torque limiter, to which a table, a pulley, an arm and the like are directly attachable, a coupling type torque limiter, which has a 15 misalignment function, or the like. A suitable type is selected and used according to need.

The electromagnetic clutch 73 is generally a device that couples, separates, brakes and holds machinery by using electromagnetic force generated by electrifying a coil. In terms of operation type, the electromagnetic clutch 73 may be an excitation operation type, which operates when the coil is electrified, or a non-excitation operation type, which operates with spring force when the coil is de-electrified, for example, at the time of blackout. In terms of structural characteristics, the electromagnetic clutch 73 may be a friction disc type, a jaw type, a powder type filled with magnetic particles (powder), a hysteresis type using hysteresis loss of a magnetic material, or the like. A suitable type is selected and used according to need.

Next, the intermediate transfer belt drive mechanism 80 includes: a second drive motor 81 that drives the driving roll 31 of the intermediate transfer belt 15; and a gear 82 that transmits driving torque of the second drive motor 81 to the driving roll 31. The second drive motor 81 is grounded through a voltmeter 84. A current value of the second drive motor 81 is measured by a current probe 83 as a measurement portion, and is then inputted to the controller 40.

In the present exemplary embodiment, changes in the rotational speed of the secondary transfer roll 22 are detected by the first rotary encoder 91, while changes in the rotational speed of the driving roll 31 of the intermediate transfer belt 15 are detected by the second rotary encoder 92. Then, output signals from the rotary encoders 91 and 92 are inputted to the controller 40.

Then, the secondary transfer roll drive mechanism 70 adjusts driving torque of the secondary transfer roll 22 by use of the torque limiter 72 and the electromagnetic clutch 73 that receive a control signal from the controller 40.

Specifically, in a normal operation, the drive torque of the first drive motor 71 is transmitted to the secondary transfer roll 22 through the torque limiter 72. When the leading edge of a sheet having a large weight such as a cardboard reaches the secondary transfer unit 20, the electromagnetic clutch 73 operates. In the present exemplary embodiment, the upper limit value of drive torque is set larger for the electromagnetic clutch 73 than for the torque limiter 72.

As described above, changes in the rotational speed of the secondary transfer roll 22 detected by the first rotary encoder 91 and changes in the rotational speed of the driving roll 31 detected by the second rotary encoder 92 are thus used for control of the drive torque for the secondary transfer roll 22.

In addition, the changes in these rotational speeds are also used for correction of the following control. Specifically, the changes are used to correct the timing at which the electromagnetic clutch 73 is to be turned on or off, in accordance with the timing at which the sheet reaches the nip portion 29 of the secondary transfer unit 20 and at which the trailing edge of the sheet leaves the nip portion 29.

Next, action of the secondary transfer roll drive mechanism 70 will be described by using FIG. 3 and FIG. 4.

Figure 4:
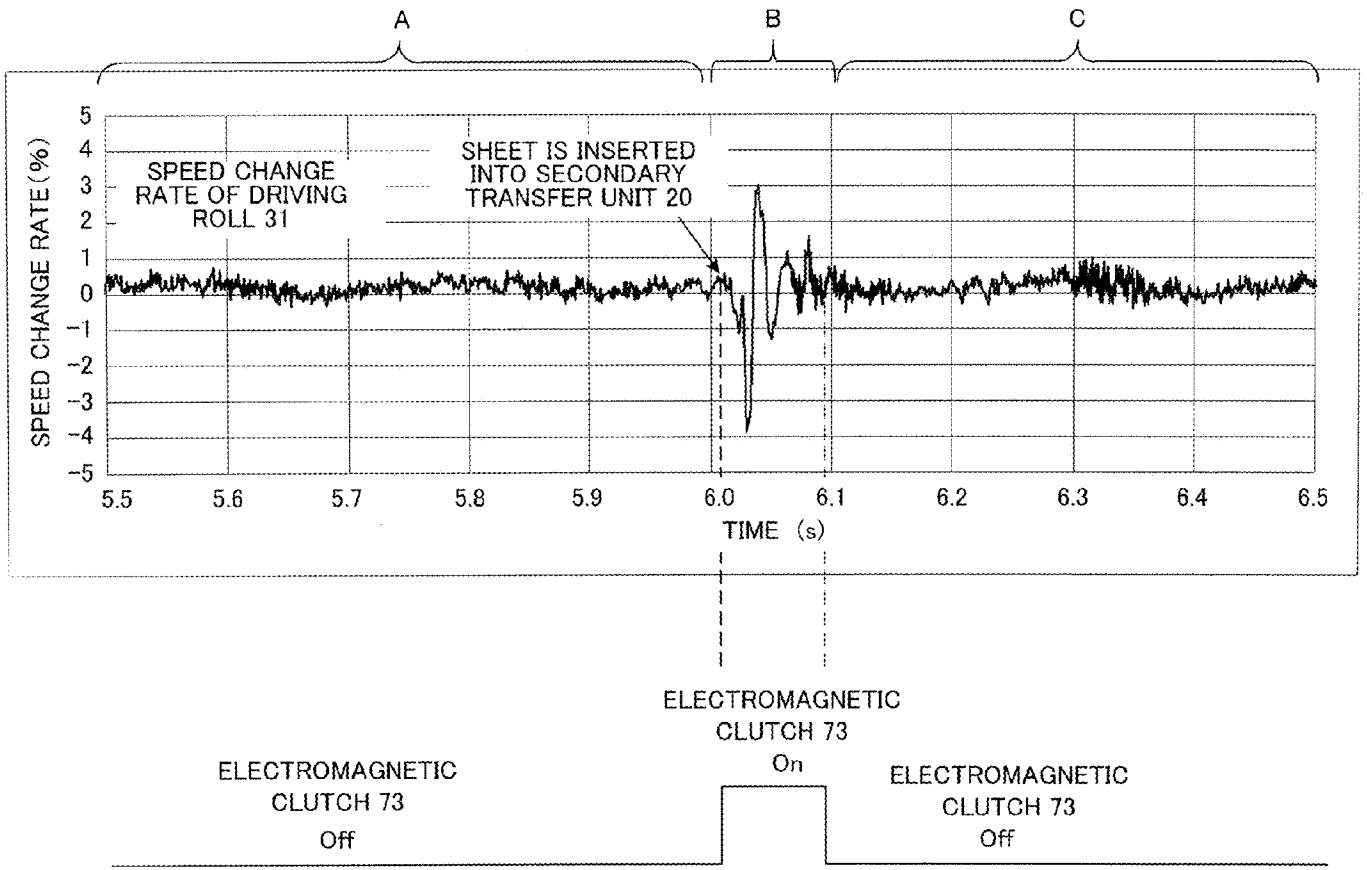
FIG. 4 is a graph showing speed change rates (%) of the driving roll that drives the intermediate transfer belt.

FIG. 4 is a graph showing speed change rates (%) of the driving roll 31 that drives the intermediate transfer belt 15. The horizontal axis shows time (seconds: s), and the vertical axis shows speed change rates (%). In FIG. 4, a period A (time 5.5 (s) to approximately time 6.0 (s)) is a state in which no sheet is provided. A period B (approximately time 6.0 (s) to approximately time 6.1 (s)) is a state in which the leading edge of the sheet reaches and then is inserted into the nip portion 29 of the secondary transfer unit 20. A period C (approximately time 6.1 (s) and thereafter) is a state in which the sheet is passing through the nip portion 29. Note that the speed change rate (%) of the driving roll 31 is detected by the second rotary encoder 92 attached to the driving roll 31, as described above.

As shown in FIG. 4, when no sheet is provided to the secondary transfer unit 20 (period A), the intermediate transfer belt 15 is rotationally driven at a constant speed, and the speed change rate (%) of the driving roll 31 is almost stable within the range of approximately ±1%. In this case, the torque of the first drive motor 71 is transmitted to the secondary transfer roll 22 through the gear train 74 (gears 74*a*, 74*b* and 74*c*), the torque limiter 72 and the gear train 75 (gears 75*c* and 75*b*).

Next, when the leading edge of a sheet having a large weight such as a cardboard is inserted into the secondary transfer unit 20, the rotational speed of the intermediate transfer belt 15 decreases due to a load applied to the secondary transfer roll 22. At the same time, the speed change rate (%) of the driving roll 31 changes to approximately −4% (period B). In this case, by performing feedback control so as to correct the speed change of the driving roll 31, the speed change rate (%) of the driving roll 31 changes to approximately +3%. Moreover, while repeatedly changing to the plus side and the minus side, the speed change rate becomes almost stable.

Such behavior of large changes in the speed change rate (%) also occurs when the trailing edge of the sheet having a large weight such as a cardboard leaves the secondary transfer unit 20. As a result, the speed changes of the intermediate transfer belt 15 occur, causing imaging failures (banding, smears and the like) to occur in the image to be formed.

In the present exemplary embodiment, the electromagnetic clutch 73 is caused to operate in the secondary transfer unit 20 in accordance with the timing when the leading edge of the sheet having a large weight such as a cardboard reaches the nip portion 29. Thereby, the state (first adjustment state) in which the drive torque of the first drive motor 71 is transmitted to the secondary transfer roll 22 through the torque limiter 72 in a normal operation is changed to the state (second adjustment state) in which the drive torque is transmitted to the secondary transfer roll 22 through the electromagnetic clutch 73.

Further, the electromagnetic clutch 73 is also caused to operate in accordance with the timing when the trailing edge of the sheet having a large weight such as a cardboard leaves the nip portion 29. Thereby, the state (first adjustment state) in which the drive torque of the first drive motor 71 is transmitted to the secondary transfer roll 22 through the torque limiter 72 is changed to the state (second adjustment state) in which the drive torque is transmitted to the secondary transfer roll 22 through the electromagnetic clutch 73.

Specifically, in a normal operation, the drive torque of the first drive motor 71 is transmitted to the secondary transfer roll 22 through the gear train 74 (gears 74*a*, 74*b* and 74*c*), the torque limiter 72 and the gears 75*c* and 75*b* of the gear train 75 (first adjustment state). In this case, the electromagnetic clutch 73 does not operate.

Next, when the leading edge of the sheet having a large weight such as a cardboard reaches the nip portion 29 of the secondary transfer unit 20 and also when the trailing edge thereof leaves the nip portion 29, the electromagnetic clutch 73 is turned on for a predetermined period upon receipt of a control signal from the controller 40. Thereby, the drive torque of the first drive motor 71 is transmitted to the secondary transfer roll 22 through the gear 74*a* of the gear train 74, the electromagnetic clutch 73 and the gears 75*a* and 75*b* of the gear train 75 (second adjustment state). In the present exemplary embodiment, the upper limit value of drive torque is set higher for the electromagnetic clutch 73 than for the torque limiter 72.

Operation start and stop (ON and OFF) of the electromagnetic clutch 73 are controlled by the controller 40 on the basis of a change in the speed of the secondary transfer roll 22 detected by the first rotary encoder 91, a current value of the second drive motor 81 measured by the current probe 83, and a change in speed of the driving roll 31 detected by the second rotary encoder 92.

Moreover, in the present exemplary embodiment, an operation (ON) voltage and operation (ON) time of the electromagnetic clutch 73 in the secondary transfer roll drive mechanism 70 are also controlled by the controller 40.

In general, the transmission rate of torque force by the electromagnetic clutch 73 is almost steplessly adjustable by the intensity of current applied to the electromagnetic clutch 73. In the present exemplary embodiment, by the operation of the electromagnetic clutch 73, torque that is larger than the upper limit torque value set in advance for the torque limiter 72 is transmitted to the secondary transfer roll 22. As a result, the secondary transfer roll 22 is forced to be rotationally driven. This prevents a decrease in speed of the intermediate transfer belt 15 and stabilizes the rotational speed of the intermediate transfer belt 15, thereby reducing occurrence of imaging failures (banding, smears and the like).

As described above, in the present exemplary embodiment, the electromagnetic clutch 73 in the secondary transfer roll drive mechanism 70 operates (ON) for a predetermined period when the leading edge of a sheet having a large weight reaches the nip portion 29 of the secondary transfer unit 20 and when the trailing edge thereof leaves the nip portion 29. The electromagnetic clutch 73 stops operating (OFF) while the sheet is passing through the nip portion 29 and while normal processing is performed. In this case, the torque of the first drive motor 71 is transmitted to the secondary transfer roll 22 through the torque limiter 72, and the speed of the intermediate transfer belt 15 is almost stable.

Next, a flow of control of the secondary transfer roll drive mechanism 70 by the controller 40 will be described by using FIGS. 3 to 5.

Figure 5:
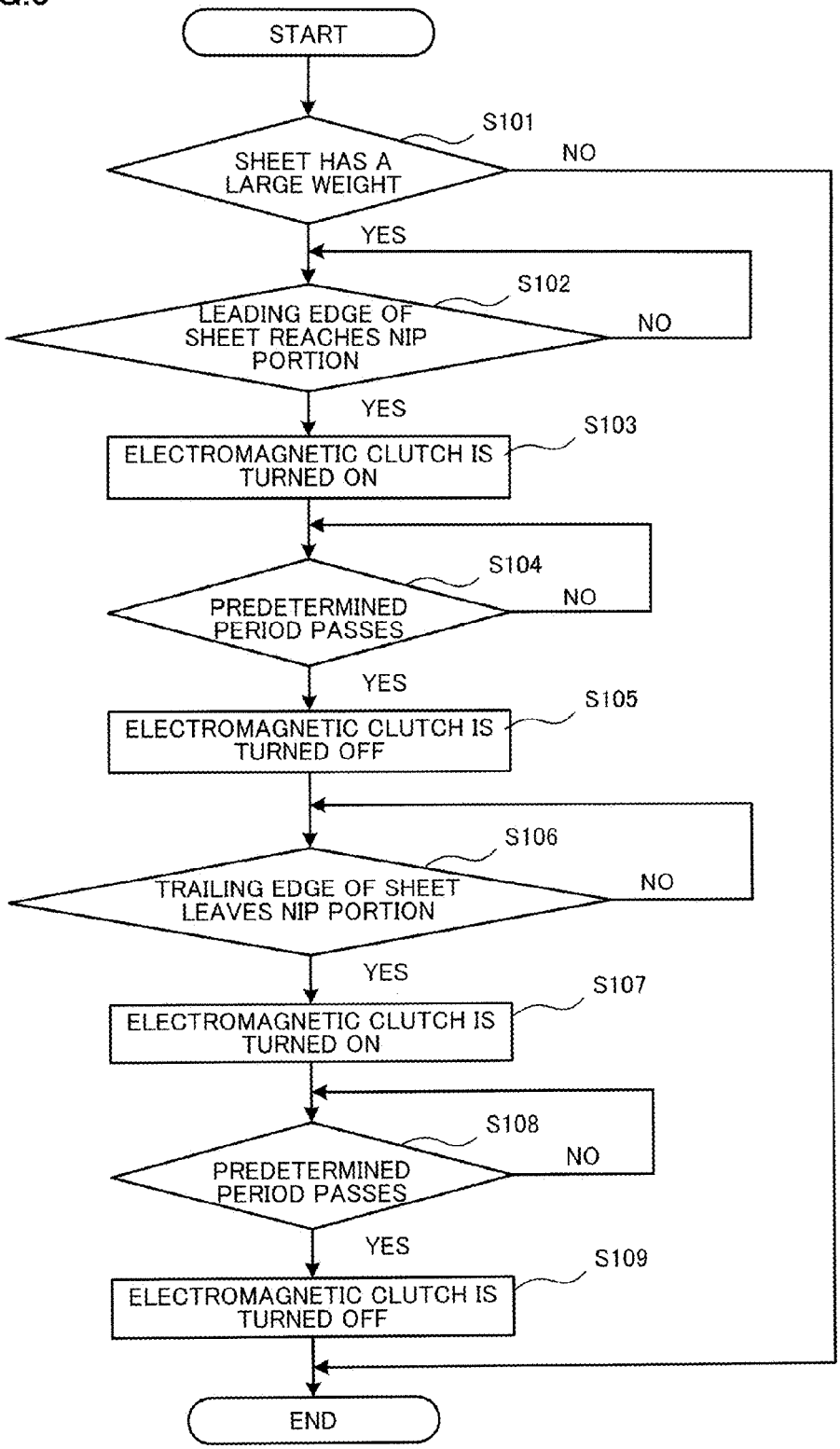
FIG. 5 is a flowchart showing the control by the controller.

FIG. 5 is a flowchart showing the control by the controller 40.

The controller 40 first judges whether or not the sheet to be transported is one having a large weight such as a cardboard (Step 101). This judgment is made, for example, by recognizing contents registered in advance by a user. For example, an input result of sheet type information inputted by a user or the like is used. If the sheet is not one having a large weight (NO in Step 101), the controller 40 terminates the process without performing any special processing, and the torque limiter 72 performs normal processing. On the other hand, if the controller 40 judges that the sheet is one having a large weight such as a cardboard (YES in Step 101), the process advances to Step 102.

In Step 102, the controller 40 judges whether or not the leading edge of the transported sheet having a large weight reaches the nip portion 29 between the intermediate transfer belt 15 and the secondary transfer roll 22 of the secondary transfer unit 20 (Step 102). This judgment is easily made, for example, by using a sensor provided on a sheet transport path and by recognizing the transportation speed of the sheet. This judgment whether or not the sheet reaches the nip portion 29 may be made, for example, immediately before a speed change as the one shown in FIG. 4 occurs (see the period B in FIG. 4), and is made immediately before the leading edge of the sheet reaches the nip portion 29 in practice. If the leading edge of the sheet having a large weight does not reach the nip portion 29 (NO in Step 102), normal processing is performed without performing any special processing. On the other hand, if the controller 40 judges that the leading edge of the sheet reaches the nip portion 29 (YES in Step 102), the process advances to Step 103.

In Step 103, the electromagnetic clutch 73 receiving a control signal from the controller 40 operates in accordance with the timing when the leading edge of the sheet reaches the nip portion 29 (Step 103). Thereby, the state (first adjustment state) in which the drive torque of the first drive motor 71 is transmitted to the secondary transfer roll 22 through the torque limiter 72 is changed to the state (second adjustment state) in which the drive torque is transmitted to the secondary transfer roll 22 through the electromagnetic clutch 73. Upon this change, the secondary transfer roll 22 is forced to be rotationally driven.

Then, the controller 40 judges whether or not the predetermined period passes after the electromagnetic clutch 73 starts to operate upon the reaching of the leading edge of the sheet to the nip portion 29 (Step 104). If the predetermined period does not pass (NO in Step 104), the operation state of the electromagnetic clutch 73 is maintained. On the other hand, if the controller 40 judges that the predetermined period passes (YES in Step 104), the process advances to Step 105. Specifically, the operation processing of the electromagnetic clutch 73 is terminated (Step 105), and the torque limiter 72 performs normal processing.

Subsequently, the controller 40 judges whether or not the trailing edge of the sheet having a large weight and inserted into the nip portion 29 leaves the nip portion 29 (Step 106). The trailing edge of the sheet is detected as a distance from the leading edge of the sheet, for example, by a sensor or the like while the sheet is transported on the sheet transport path. Since each sheet may have different length, the trailing edge of the sheet may be recognized for each sheet.

The judgment of whether or not the trailing edge of the sheet leaves the nip portion 29 may be made, for example, immediately before a speed change as one shown in FIG. 4 occurs (see the period B in FIG. 4), and is made immediately before the trailing edge of the sheet leaves the nip portion 29 in practice. If the trailing edge of the sheet having a large weight does not leave the nip portion 29 (NO in Step 106), normal processing is performed without performing any special processing. On the other hand, if the controller 40 judges that the trailing edge of the sheet leaves the nip portion 29, (YES in Step 106), the process advances to Step 107.

In Step 107, the electromagnetic clutch 73 receiving a control signal from the controller 40 operates in accordance with the timing when the trailing edge of the sheet leaves the nip portion 29 (Step 107). Thereby, the state (first adjustment state) in which the torque limiter 72 performs the normal processing is changed to the state (second adjustment state) in which the electromagnetic clutch 73 is operating. Upon this change, the secondary transfer roll 22 is forced to be rotationally driven.

Then, the controller 40 judges whether or not the predetermined period passes after the electromagnetic clutch 73 starts to operate in accordance with the timing when the trailing edge of the sheet leaves the nip portion 29 (Step 108). If the predetermined period does not pass (NO in Step 108), the operation state of the electromagnetic clutch 73 is maintained. On the other hand, if the controller 40 judges that the predetermined period passes (YES in Step 108), the process advances to Step 109. Specifically, the operation processing of the electromagnetic clutch 73 is terminated (Step 109), and the torque limiter 72 performs normal processing.

As described above, in the present exemplary embodiment, the electromagnetic clutch 73 in the secondary transfer roll drive mechanism 70 operates (ON) so as to transmit the torque of the first drive motor 71 to the secondary transfer roll 22, when the leading edge of a sheet having a large weight such as a cardboard reaches the nip portion 29 of the secondary transfer unit 20, and when the trailing edge of the sheet leaves the nip portion 29. The electromagnetic clutch 73 stops operating (OFF) while the sheet is passing through the secondary transfer unit 20. In this case, the torque of the first drive motor 71 is transmitted to the secondary transfer roll 22 through the torque limiter 72, and the speed change rate (%) of the intermediate transfer belt 15 is almost stable within the range of approximately ±1%.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holder that holds an image;

a transfer unit that includes a transfer member being rotationally driven and forming a pressing portion between the transfer member and the image holder, and that presses a recording medium under transportation at the pressing portion so as to transfer the image held by the image holder onto the transported recording medium; and an adjustment unit that adjusts drive torque for the transfer member by changing the drive torque from a first adjustment state to a second adjustment state, any one of when a leading edge of the recording medium reaches the pressing portion and when a trailing edge of the recording medium leaves the pressing portion, wherein the adjustment unit operates an electromagnetic clutch so as to change the drive torque to the second adjustment state, in accordance with any one of timing at which the leading edge of the recording medium reaches the pressing portion and timing at which the trailing edge of the recording medium leaves the pressing portion.

2. The image forming apparatus according to claim 1, wherein the adjustment unit forms the first adjustment state by using a torque limiter that controls an upper limit value of the drive torque transmitted to the transfer member.

3. The image forming apparatus according to claim 1, wherein an upper limit value of the drive torque for the transfer member is set higher in the second adjustment state of the adjustment unit than in the first adjustment state.

4. An image forming apparatus comprising:

an image holder that holds an image;

a transfer unit that includes a transfer member being rotationally driven and forming a pressing portion between the transfer member and the image holder, and that presses a recording medium under transportation at the pressing portion so as to transfer the image held by the image holder onto the transported recording medium; and an adjustment unit that adjusts drive torque for the transfer member by changing the drive torque from a first adjustment state to a second adjustment state, any one of when a leading edge of the recording medium reaches the pressing portion and when a trailing edge of the recording medium leaves the pressing portion, wherein the adjustment unit forms the first adjustment state by using a torque limiter that controls an upper limit value of the drive torque transmitted to the transfer member.

5. The image forming apparatus according to claim 4, wherein the upper limit value of the drive torque for the transfer member is set higher in the second adjustment state of the adjustment unit than in the first adjustment state.

* * * * *